US005638644A

United States Patent [19]

Bastian

[11] Patent Number: 5,638,644

[45] Date of Patent: Jun. 17, 1997

[54] WALL SUPPORT ASSEMBLY

[75] Inventor: John M. Bastian, Manitowoc, Wis.

[73] Assignee: Fisher Hamilton Scientific Inc., Two Rivers, Wis.

[21] Appl. No.: 692,882

[22] Filed: Aug. 1, 1996

Related U.S. Application Data

[63] Continuation of Ser. No. 324,002, Oct. 13, 1994, abandoned.

[51] Int. Cl.[6] ..... E04B 2/76

[52] U.S. Cl. ..... 52/36.6; 52/656.1; 211/90; 211/94; 403/363

[58] Field of Search ..... 52/36.1, 36.6, 52/656.1, 657, 658; 108/106, 108, 144; 211/90, 94, 103, 187; 256/22; 403/363, DIG. 10

[56] References Cited

U.S. PATENT DOCUMENTS

| | | | |
|---|---|---|---|
| D. 286,495 | 11/1986 | Blomdahl . | |
| D. 342,015 | 12/1993 | Andrewjew . | |
| 2,105,771 | 1/1938 | Holdsworth | 52/656.1 X |
| 3,680,271 | 8/1972 | Satchell | 52/656.1 |
| 3,733,755 | 5/1973 | Butler | 52/36.6 |
| 3,845,601 | 11/1974 | Kostecky | 52/656.1 X |
| 3,993,002 | 11/1976 | Stroh . | |
| 4,019,291 | 4/1977 | Ernst | 403/363 X |
| 4,029,025 | 6/1977 | Lundqvist | 108/108 |
| 4,058,951 | 11/1977 | Dean | 52/656.1 |
| 4,098,481 | 7/1978 | Johnson et al. . | |
| 4,122,955 | 10/1978 | Celms | 108/108 X |
| 4,185,422 | 1/1980 | Radek | 52/656.1 X |
| 4,370,838 | 2/1983 | Vermillion | 52/36.6 |
| 4,620,489 | 11/1986 | Albano . | |
| 4,709,517 | 12/1987 | Mitchell et al. | 52/36.6 |
| 4,809,476 | 3/1989 | Satchell | 52/656.1 X |
| 4,968,005 | 11/1990 | Zen | 256/22 |
| 5,038,689 | 8/1991 | Duffy . | |
| 5,072,839 | 12/1991 | Arnone . | |
| 5,110,080 | 5/1992 | Rieman | 211/94 X |

FOREIGN PATENT DOCUMENTS

| | | | |
|---|---|---|---|
| 579149 | 7/1959 | Canada | 52/36.6 |

*Primary Examiner*—Carl D. Friedman
*Assistant Examiner*—Kevin D. Wilkens
*Attorney, Agent, or Firm*—Tilton, Fallon, Lungmus & Chestnut

[57] ABSTRACT

A wall support assembly includes a pair of horizontal members and one or more vertical members. One may secure the horizontal members to a wall member a predetermined distance apart. Each of the horizontal members defines a recess or pocket which lies longitudinally of the member for releasably receiving a distal end portion of a vertical member. The vertical members define openings from which one may hang storage members or similar components.

12 Claims, 3 Drawing Sheets

WALL SUPPORT ASSEMBLY

This application is a continuation of application Ser. No. 08/324,002, filed Oct. 13, 1994, now abandoned.

BACKGROUND OF THE INVENTION

1. Field of the Invention

The present invention relates to a support assembly used to mount various components to a wall, and more particularly to a support assembly with horizontal aria vertical rails that provide a low profile structure for mounting storage enclosures and similar structures to a wall. The present invention finds particular utility for mounting laboratory components, but it may serve as a wall mount in a wide variety of other applications.

2. Description of the Prior Art

The prior art includes a wide variety of wall mounting structures. Some of these structures do not provide the load capacity required for applications such as mounting laboratory enclosures or furniture to the walls of the laboratory. Those that do provide adequate load capacity are massive structures or complex devices which do not allow quick and easy installation.

The wall support assembly of the present invention avoids the disadvantages of the prior art wall mounting structures. It provides a low profile rail system which mounts directly to a wall. It allows quick and easy assembly and installation. It is a simple structure which minimizes the cost of fabrication and installation.

SUMMARY OF THE INVENTION

In accordance with one embodiment of the present invention, a wall support assembly includes a first and second elongate member which are securable to a wall member a predetermined distance apart from each other. At least one other elongate member lies disposed between the first and second members. Each of the first and second members defines a recess or pocket for releasably receiving a distal end portion of the other member.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment one should understand that the invention is not limited to this embodiment. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS AND AN EMBODIMENT

Figure 1:
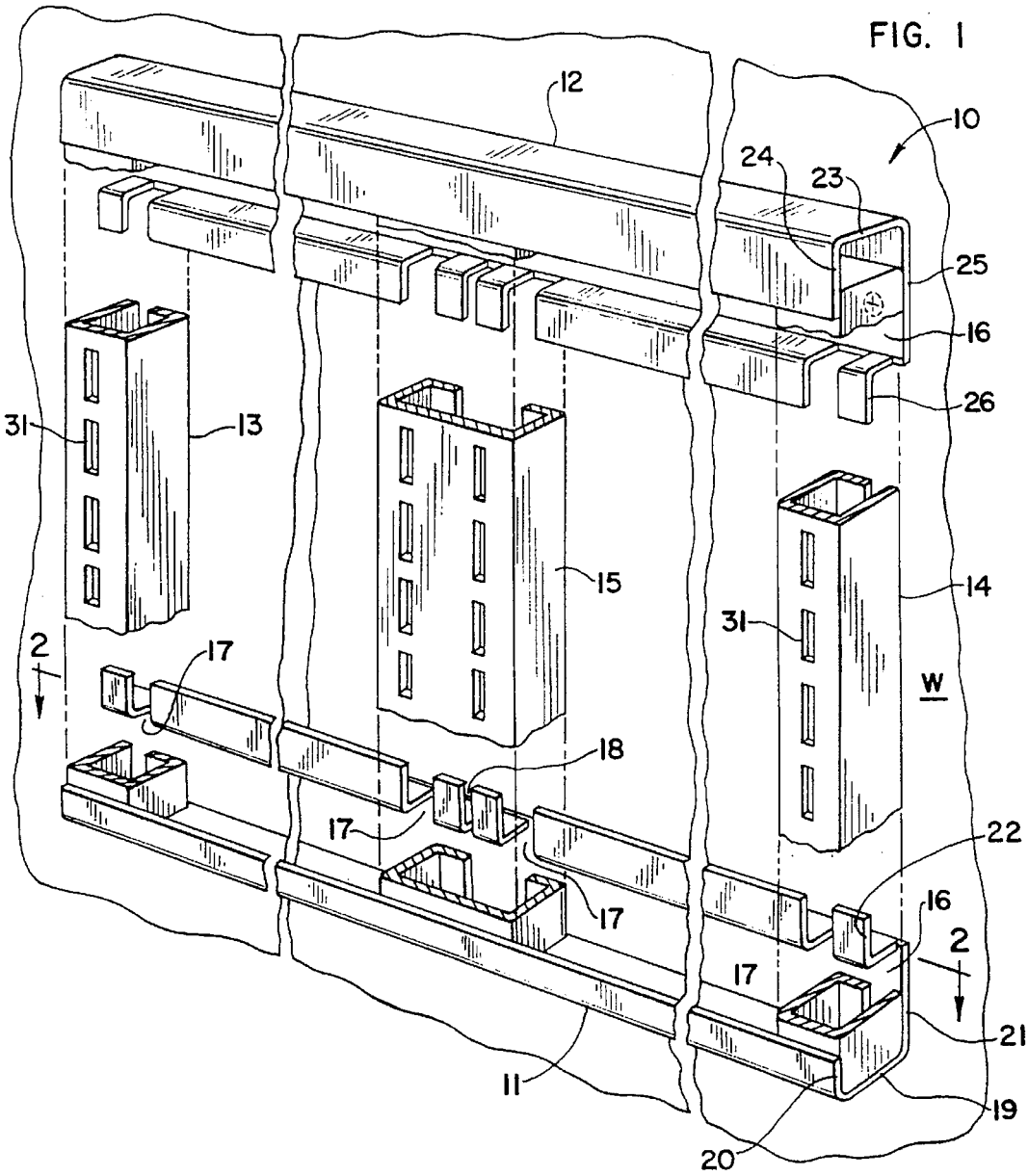
FIG. 1 is a perspective view of the wall support assembly of the present invention.

Turning now to the drawings, FIG. 1 shows the wall support system of the present invention at 10. The system generally includes a first horizontal member 11, a second horizontal member 12, a first vertical end member 13, a second vertical end member 14, and at least one member 15 which lies between the vertical end members 13 and 14. The horizontal members lie fixedly secured to a wall W; and they receive distal end portions of the vertical members as described below.

The assembly 10 shown in FIG. 1 includes one intermediate member 15. However, the assembly may include two or more intermediate members 15, or it may not include any intermediate members at all. Furthermore, the assembly 10 may include only one or more end members or only one or more intermediate members depending on the loading requirements of the application of the present invention.

Figure 2:
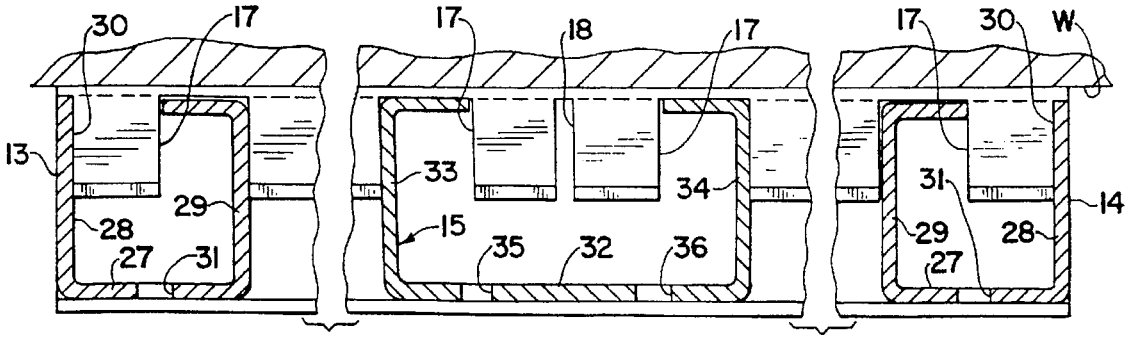
FIG. 2 is a sectional view taken along line 2—2 in FIG. 1.

The members 11–15 are elongate members made out of metal, plastic or any other material of high strength and rigidity. The horizontal members 11 and 12 have a channel-like cross-sectional configuration (See FIGS. 1, 2 and 4). Each one defines a recess or pocket 16 which extends along its entire length and receives distal ends of the vertical members 13–15. Each of the members 11 and 12 also defines slots 17 and 18 disposed at predetermined spacing along the length of the member. Those slots receive edge portions of the vertical members as shown in FIG. 2.

The bottom horizontal member 11 includes a bottom portion 19 and two leg portions 20 and 21. The leg portion 21 extends outwardly of the bottom portion 19, a greater distance than does the leg portion 20. This leg portion 21 includes a generally S-shaped end portion 22 which defines the slots 17 and 18.

Figure 3:
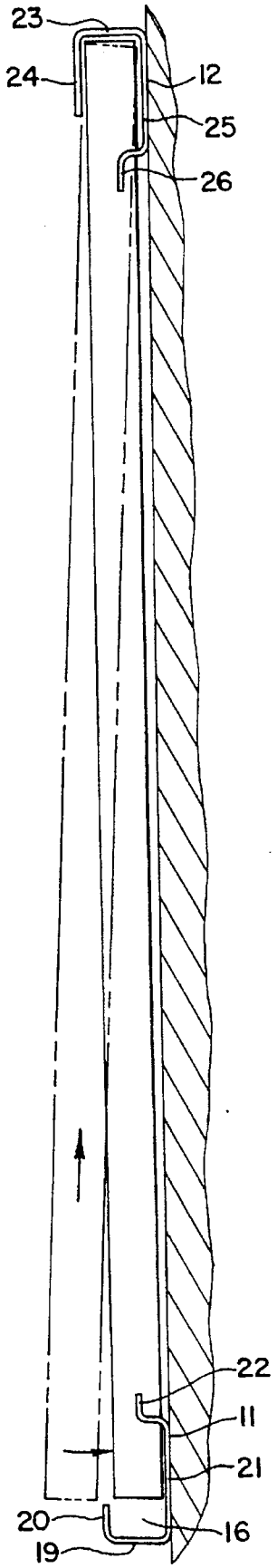
FIGS. 3 and 4 are side elevational view which illustrate the method of securing a vertical member between two horizontal members.
Figure 4:
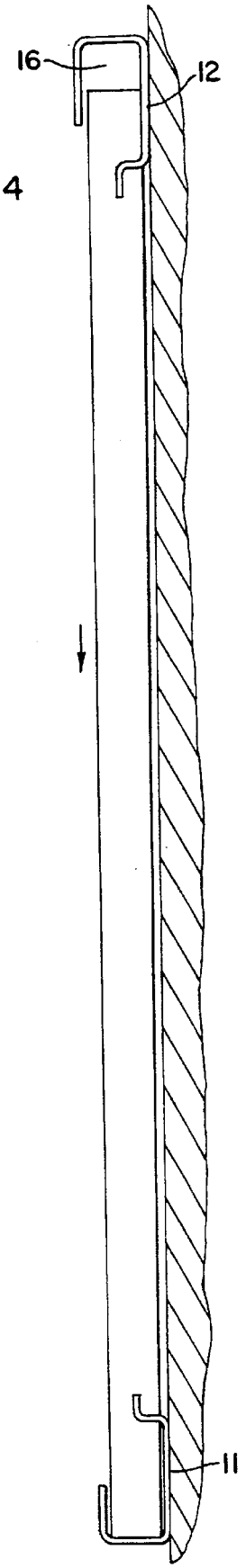

Similarly, the top horizontal member 12 includes a top portion 23 and two leg portions 24 and 25. The leg portion 25 extends outwardly of the top portion 23, a greater distance than does the leg portion 24. This leg portion 24 includes a generally S-shaped end portion 26 which defines slots 17 and 18. The cross-sectional configuration of the members 11 and 12 and the position of one of the members 11 and 12 with respect to the other allow the insertion of the distal ends of the vertical members 13–15 as shown in FIGS. 3 and 4.

The vertical members 13–15 also have generally channel-like cross-sectional configurations with each member defining an elongate, inside pocket. Each one of the end members 13 and 14 includes a bottom portion 27, a straight leg portion 28, and an L-shaped leg portion 29. (The leg portions 28 and 29 may be straight or L-shaped. The L-shape provides additional strength.) The leg portion 28 extends into a recess 30 in the members 11 and 12; and the leg portion 29 extends into a slot 17. In addition, each of the end members 13 and 14 defines a plurality of openings 31 disposed in end to end relation a predetermined distance apart along the entire length of the member. Hook members (not shown) extend into these openings 31 to hang the various components from the system.

The vertical member 15 includes a bottom portion 32 and two L-shaped leg portions 33 and 34 which extend into the slots 17 (See FIG. 2). (The slot 18 disposed between the slots 17, which receive the leg portions 33 and 34, allows the insertion of an end member in the position occupied by the intermediate member 15.) This member is wider than the end members 13 and 14 to accommodate two columns of openings 35 and 36. The two columns of openings 35 and 36 allow a user to hang components in side by side relation. In other words, the intermediate member 15 typically support the ends of two adjacent components.

Conventional screws or other similar devices (not shown) secure the horizontal members 11 and 12 to the wall member W. Similarly, one may use such securing means to secure the vertical members 13–15 to the wall after placing the distal ends of the vertical members in the pockets defined by the horizontal members 11 and 12. Securing the vertical members 13–15 in this manner provides a more secure installation.

FIGS. 3 and 4 show the method of installing the vertical members 13–15 to the horizontal members 11 and 12. As shown, the first step comprises inserting a distal end of a vertical member into the pocket of the first horizontal member 11 or the second horizontal member 12. The next step comprises inserting the opposite distal end in the pocket of the opposite horizontal member.

Figure 5:
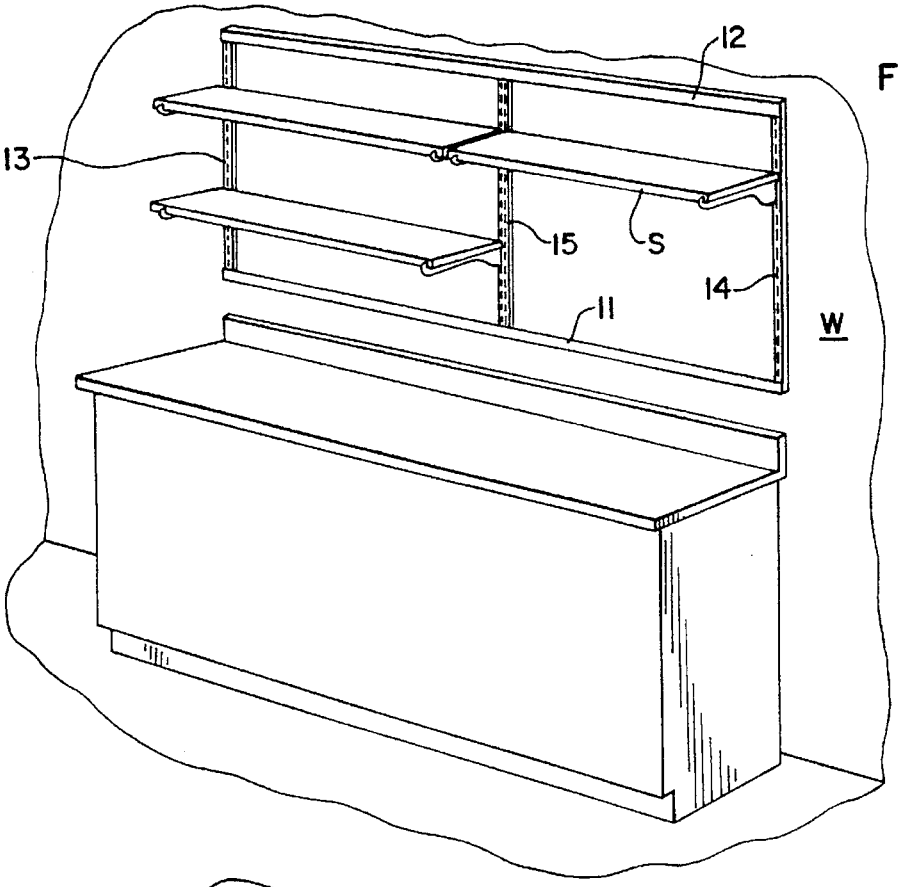
FIG. 5 is a perspective view of a wall support assembly of the present invention mounted above a cabinet which lies disposed against a wall which supports the assembly.
Figure 6:
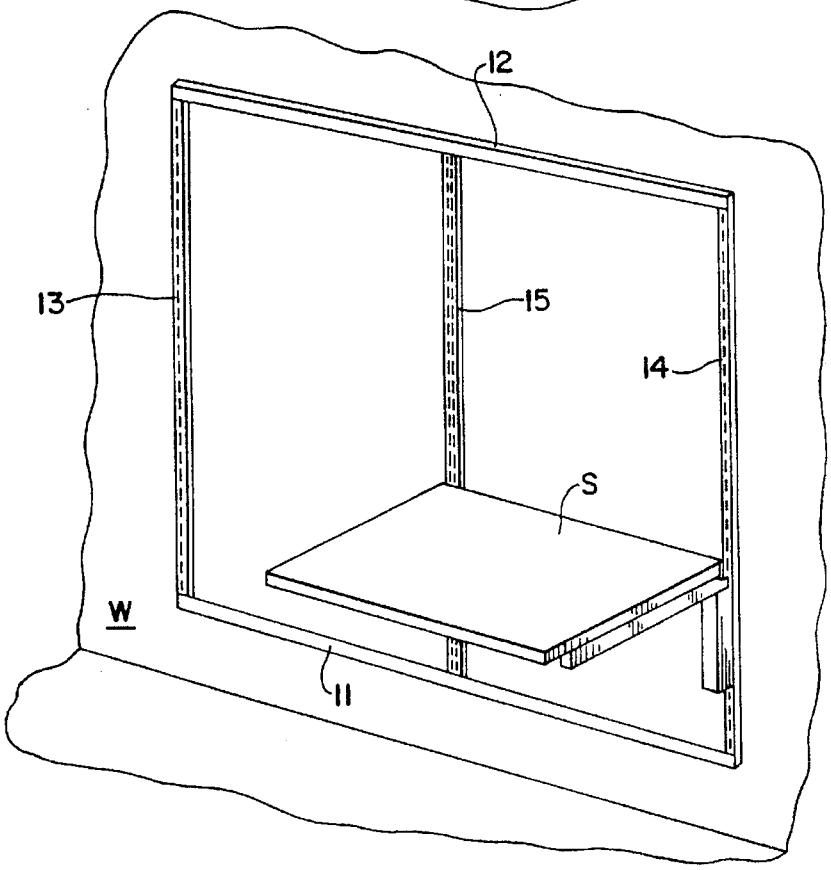
FIG. 6 is a perspective view of the wall support assembly of the present invention mounted to a wall and supporting a shelf assembly.

The assembly 10 mounts various components, such as storage units, shelves S or similar components to a wall (See FIGS. 5 and 6). These components hang from hooks which extend into the openings defined by the vertical members 13–15. In addition, the vertical members 13–14 may support panels (e.g., steel, fabric, etc.) inserted between the vertical members to provide decorative or sound absorbing wall covering or tackable surfaces. The assembly provides a low profile rail system which mounts directly to the wall. This assembly allows quick and easy installation to the wall.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A wall support assembly comprising:

a first, elongate member securable to a wall member;

a second, elongate member securable to the wall member a predetermined distance away from said first member;

a third, elongate member for extending between said first and second members;

each of said first and second members defining a recess disposed longitudinally of the member for releasably receiving a distal end portion of said third member;

each of the first and second members defining at least one transverse slot and one transverse end portion;

the third member defining a pocket and at least one leg portion;

the slots of the first and second members receiving the leg portion of the third member;

and the pocket of the third member receiving the end portions of the first and second members;

distal ends of the third member extending into the recess of the first and second members in loose, sliding engagement.

2. The assembly of claim 1, further comprising means for securing the first and second members to the wall member.

3. The assembly of claim 1, wherein the recess defined by each of the first and second members extends along the entire length of the first or second member.

4. The assembly of claim 1, wherein the first and second members are adapted to lie in spaced, parallel relation to each other.

5. The assembly of claim 4, wherein the third member is adapted to lie perpendicularly to the first and second members.

6. The assembly of claim 1, wherein the first and second members have a generally channel-like cross-section.

7. The assembly of claim 6, wherein the third member has a generally channel-like cross-section.

8. The assembly of claim 1, further comprising a fourth member, the recess defined by the first and second members receiving a distal end portion of the fourth member.

9. The assembly of claim 1, wherein the first, second and third members are one-piece integrally formed components.

10. A wall support assembly comprising:

first and second elongate, horizontal members, said first and second horizontal members being secured to a wall member generally parallel to each other and a predetermined distance apart;

a plurality of elongate, vertical members disposed generally perpendicularly to the horizontal members between the horizontal members;

each of said horizontal members defining a recess disposed longitudinally of the horizontal member for releasably receiving a distal end portion of each of the vertical members;

the distal ends of vertical members extending into the recesses or the first and second members in loose, sliding engagement;

each of the first and second members defining at least one transverse slot and one transverse end portion;

the vertical members defining a pocket and at least one leg portion; the slots of the first and second members receiving the leg portion of the vertical members; and the pocket of the vertical members receiving the end portions of the first and second members.

11. The assembly of claim 10, wherein each vertical member defines a plurality of openings for receiving a hook of a storage member or the like, said openings being spaced from each other and disposed longitudinally of the vertical member.

12. The assembly of claim 10, wherein the first, second and vertical members are one-piece integrally formed components.

* * * * *